US010107278B2

(12) United States Patent
Chou

(10) Patent No.: US 10,107,278 B2
(45) Date of Patent: Oct. 23, 2018

(54) AIR COMPRESSOR WITH AUDIBLE ALARM DEVICE

(71) Applicant: Wen-San Chou, Tainan (TW)

(72) Inventor: Wen-San Chou, Tainan (TW)

( * ) Notice: Subject to any disclaimer, the term of this patent is extended or adjusted under 35 U.S.C. 154(b) by 786 days.

(21) Appl. No.: 14/572,047

(22) Filed: Dec. 16, 2014

(65) Prior Publication Data

US 2015/0184668 A1 Jul. 2, 2015

(30) Foreign Application Priority Data

Dec. 30, 2013 (TW) ..... 102149140 A

(51) Int. Cl.

| | |
|---|---|
| ***F04B 39/14*** | (2006.01) |
| ***F04B 35/04*** | (2006.01) |
| ***F04B 35/06*** | (2006.01) |
| ***F04B 39/12*** | (2006.01) |
| ***F04B 41/02*** | (2006.01) |
| ***F04B 49/10*** | (2006.01) |

(52) U.S. Cl.

CPC ..... *F04B 39/14* (2013.01); *F04B 35/04* (2013.01); *F04B 35/06* (2013.01); *F04B 39/12* (2013.01); *F04B 41/02* (2013.01); *F04B 49/106* (2013.01); *F04B 2205/05* (2013.01); *F04B 2207/701* (2013.01)

(58) Field of Classification Search

CPC ..... F04B 39/12; F04B 39/14; F04B 39/066; F04B 39/121; F04B 35/04; F04B 35/06; F04B 53/08; F04B 53/16; F04B 53/22; F04B 25/082; F04B 29/403; F04B 29/601; F04B 41/02; F04B 2207/701

USPC ..... 92/171.1

See application file for complete search history.

(56) References Cited

U.S. PATENT DOCUMENTS

2005/0186084 A1* 8/2005 Wang ..... F04B 33/005 417/63

FOREIGN PATENT DOCUMENTS

EP 2353848 * 10/2011 ..... B29C 73/16

* cited by examiner

*Primary Examiner* — Kenneth J Hansen

(57) ABSTRACT

An air compressor includes an audible alarm device mounted to an outlet of a storage container thereof to produce a high-frequency sound for alerting users when compressed air produced in a cylinder thereof exceeds a predetermined value, wherein the sliding cap of the audible alarm device can be driven by the compressed air to perform a quick, slight back-and-forth movement of high frequency, so that the sliding cap can be partially moved out of the opening of an external enclosure and thus exposed to the outside. Through the audible alarm device, users can be alerted effectively to overpressure conditions of the air compressor.

12 Claims, 15 Drawing Sheets

AIR COMPRESSOR WITH AUDIBLE ALARM DEVICE

BACKGROUND OF THE INVENTION

1. Technical Field of the Invention

The present invention relates to an air compressor and, more particularly, to an air compressor that includes an audible alarm device mounted to an outlet of a storage container thereof for producing a high-frequency sound for alerting users when compressed air produced in a cylinder thereof exceeds a predetermined value, wherein the sliding cap of the audible alarm device can be driven by the compressed air to perform a quick, slight back-and-forth movement of high frequency, so that the sliding cap can be partially moved out of the opening of an external enclosure thereof and thus exposed to the outside.

2. Description of the Prior Art

In early period, the air storage container used in air compressors is only provided with two outlet tubes or ducts, one of which can be connected with a pressure gauge and the other of which can be connected with a hose for inflating an object. For improving the function of an air compressor, a multi-duct air compressor, U.S. Pat. No. 7,462,018 issued to the applicant, was disclosed. In the patent, the air storage container is provided with multiple ducts, wherein one of the ducts can be installed with a pressure gauge while the rest of the ducts can be installed with a safety valve which allows the air within the air storage container or the cylinder to be released automatically, when the air pressure exceeds a predetermined value, to protect the operation of inflating objects. Alternatively, one of the ducts can be installed with a manually-operated relief valve; therefore, when overpressure occurs, a user may operate the relief valve to release the air within the storage container or the cylinder, so that the object to be inflated can be prevented from damages due to overpressure.

To enable users to know the air pressure in the storage container or the cylinder, most of existing air compressors are equipped with a round-boxed pressure gauge, which employs a pointer driven by various mechanical elements. However, it is difficult for a user to identify the reading value of the pressure gauge when working in a dark environment or at nights. Furthermore, although the air compressor is equipped with a pressure gauge for providing a visual indication, the user cannot recognize an overpressure condition of the air compressor when the gauge is incidentally failed; in this case, the air compressor may unduly inflate an object, thereby causing damages to the object. Even though one of the ducts is installed with a safety valve for protecting the operation of inflating objects, the cost of the air compressor will be increased accordingly. Besides, after a long-period use, the safety valve may fail; thus, when inflating a tire, the tire may be overly inflated, which may cause a blowout, or the air compressor may be overheated or failed.

In view of the foregoing, for solving the problems of the existing air compressors wherein the pressure gauge cannot alert users to overpressure in any circumstances, and the incorporation of a safety valve will increase the cost of an air compressor, the applicant has contrived a novel air compressor, which can alert a user to an overpressure condition through an audible alarm device without installing a safety valve.

SUMMARY OF THE INVENTION

One object of the present invention is to provide an air compressor that includes an audible alarm device mounted to an outlet of a storage container thereof to produce a high-frequency sound for alerting users when the air pressure exceeds a predetermined value.

Another object of the present invention is to provide an air compressor, wherein the sliding cap of the audible alarm device can be driven by compressed air to perform a quick, slight back-and-forth movement of high frequency when the air pressure exceeds a predetermined value, whereby the sliding cap can be partially moved out of the opening of an external enclosure thereof and thus exposed to the outside.

A further object of the present invention is to provide an air compressor, wherein the audible alarm device is conveniently and detachably mounted to the outlet through an adapter.

A still further object of the present invention is to provide an air compressor, wherein the storage container thereof is detachably connected to a cylinder thereof, and the audible alarm device is mounted to an outlet of the storage container.

Other objects, advantages, and novel features of the present invention will become more apparent from the following detailed description when taken in conjunction with the accompanying drawings.

DETAILED DESCRIPTION OF THE PREFERRED EMBODIMENTS

Figure 11:
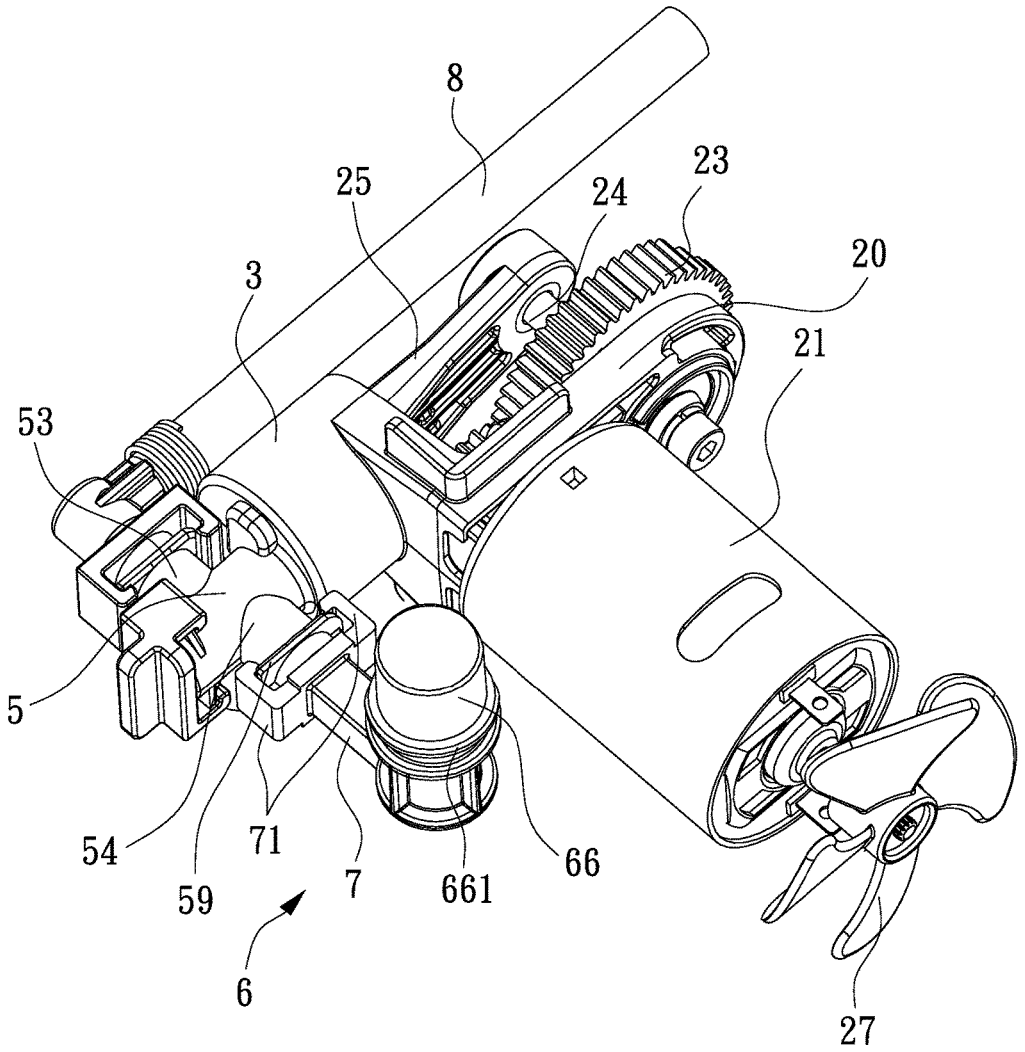
FIG. 11 shows a 3-dimensional view of a compressor unit according to a second embodiment of the present invention, wherein the audible alarm device is mounted to the storage container through an adapter.
Figure 12:
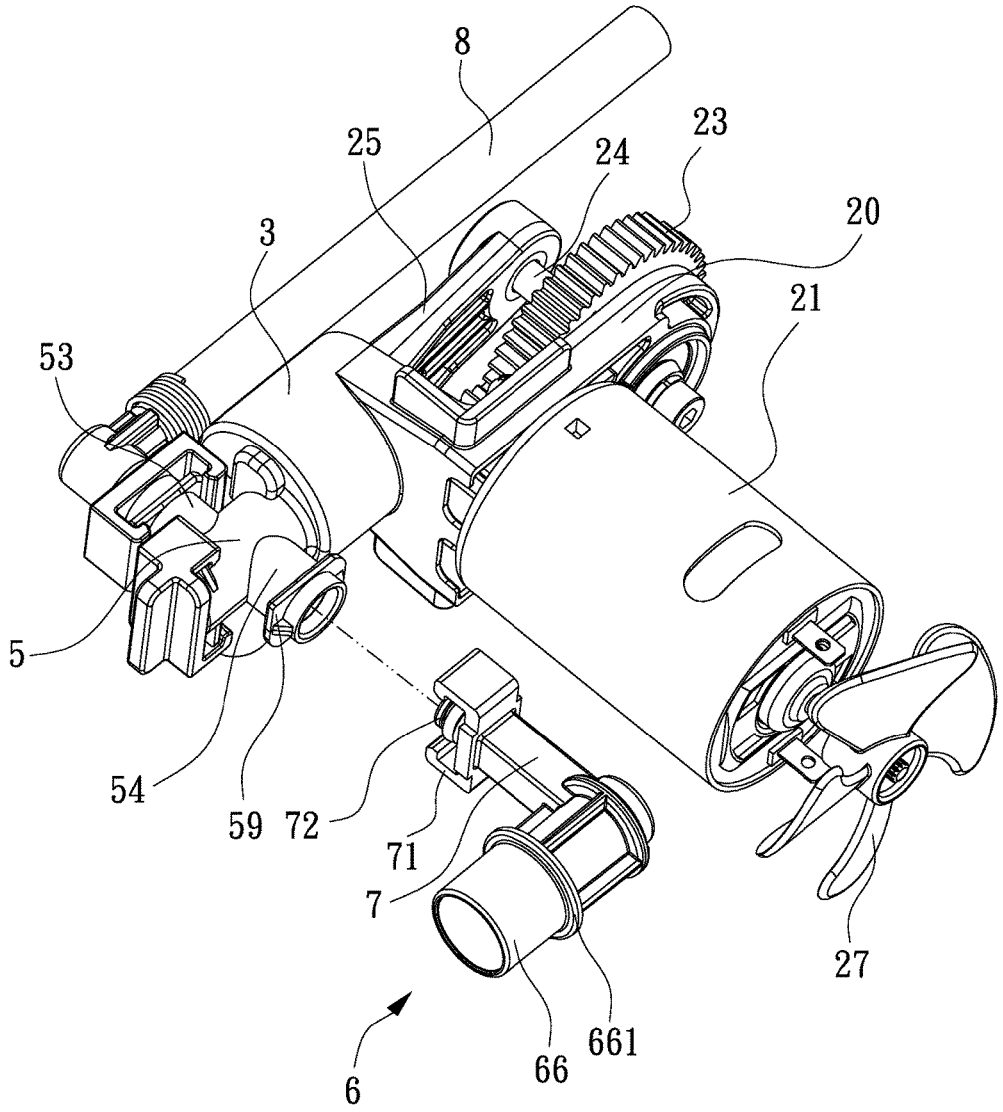
FIG. 12 shows an exploded view of the compressor unit of the second embodiment of the present invention.
Figure 13:
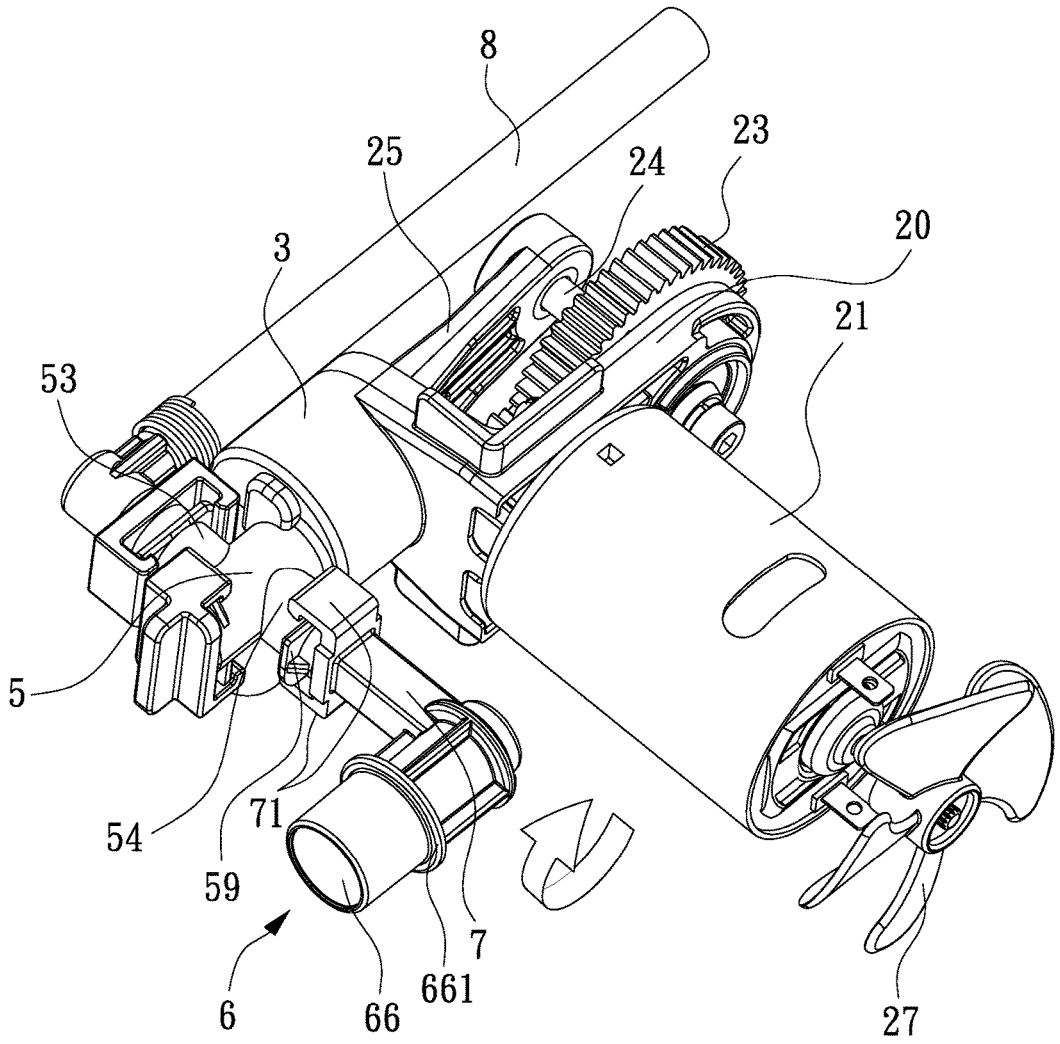
FIG. 13 shows a schematic view of the compressor unit of the second embodiment of the present invention, wherein an assembling operation between the audible alarm device and the cylinder of the compressor unit is shown.
Figure 14:
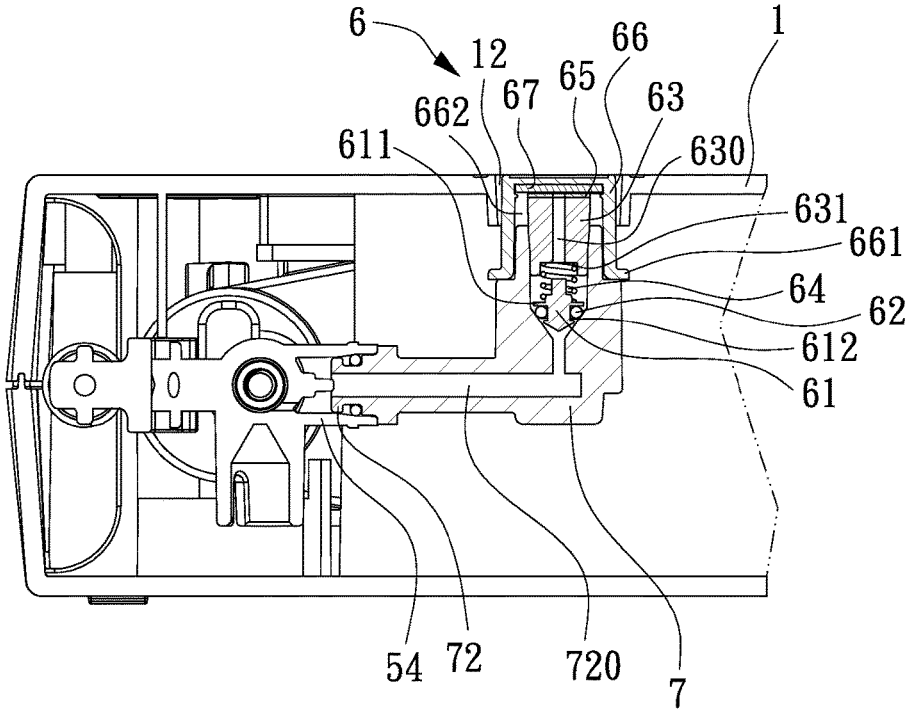
FIG. 14 shows a schematic view of the air compressor of the second embodiment of the present invention, wherein the sliding cap of the audible alarm device is at its initial position.

Referring first to FIGS. 1, 2, 3 and 8, an air compressor according to a first embodiment of the present invention is shown, which generally comprises an external enclosure 1 and a compress unit within the enclosure 1. The external enclosure 1 is provided at its outer surface with a rocker-type switch 11 electrically connected with the compressor unit and defines at its outer surface an opening 12. The compressor unit generally includes a cylinder 3 and a motor 21. The cylinder 3, which communicates with a storage container 5 via a through hole 34, is fitted with a piston body 25 which has a piston head 26. The motor 21, with a cooling fan 27, is fixed to a main housing 20. Through a mechanism including a small gear 22, a large gear 23, a crankpin 24, and a counterweight 28, the motor 21 can drive the piston 25 to conduct a reciprocating motion in the cylinder 3, so that compressed air produced in the inner space 35 of the cylinder 3 can overcome the urging force of a compression spring 42, which forces a valve plug 41 to normally close the through hole 34, to have the valve plug 41 moved upwardly, so that the compressed air can enter the storage container 5. Furthermore, the storage container 5 is provided with a plurality of outlets 53, 54. In this embodiment, the outlets 53, 54 are integrally formed with the storage container 5. The outlet 53 can be connected with a hose 8 (see FIG. 11). The primary feature of the present invention is that the outlet 54 can be mounted with an audible alarm device 6 to produce a warning sound for alerting users when the compressed air within the storage container 5 or the cylinder 3 exceeds a predetermined pressure, so that the compressor unit can be operated more conveniently and safely to inflate an object without causing overpressure.

The cylinder 3 has a top wall 31 and an open bottom 32. The top wall 31 of the cylinder 3 is formed with a first coupling means 33 that includes two substantially opposite plates 330 extending outwardly from the top wall 31, wherein one side of each plate 330 is formed into a first holding portion 331 defining a first receiving slot 3310. The storage container 5 defines therein an inner space 52 and has a closed top and an open bottom 51. The open bottom 51 is formed with a second coupling means 55 that includes two substantially opposite plates 551 extending outwardly from the surrounding wall of the storage container 5, wherein one side of each opposite plate 551 is formed into a second holding portion that has a base section 552 and an end section 553, wherein the base section 552 is perpendicular to the corresponding plate 551 of the storage container 5; the end section 553 is parallel to the corresponding plate 551 of the storage container 5 to thus define a second receiving slot 550 between the base section 552 and the end section 553. In mounting the storage container 5 to the cylinder 3, as shown in FIGS. 3 through 6, the storage container 5 can be rotated to allow the plates 551 thereof to slide in the first receiving slots 3310 and allow the plates 330 of the cylinder 3 to slide in the second receiving slots 550, wherein the plates 330 of the cylinder 3 can be limited by the base sections 552 of the storage container 5 to save unnecessary rotation, so that the storage container 5 can be firmly and detachably mounted to the cylinder 3.

Figure 1:
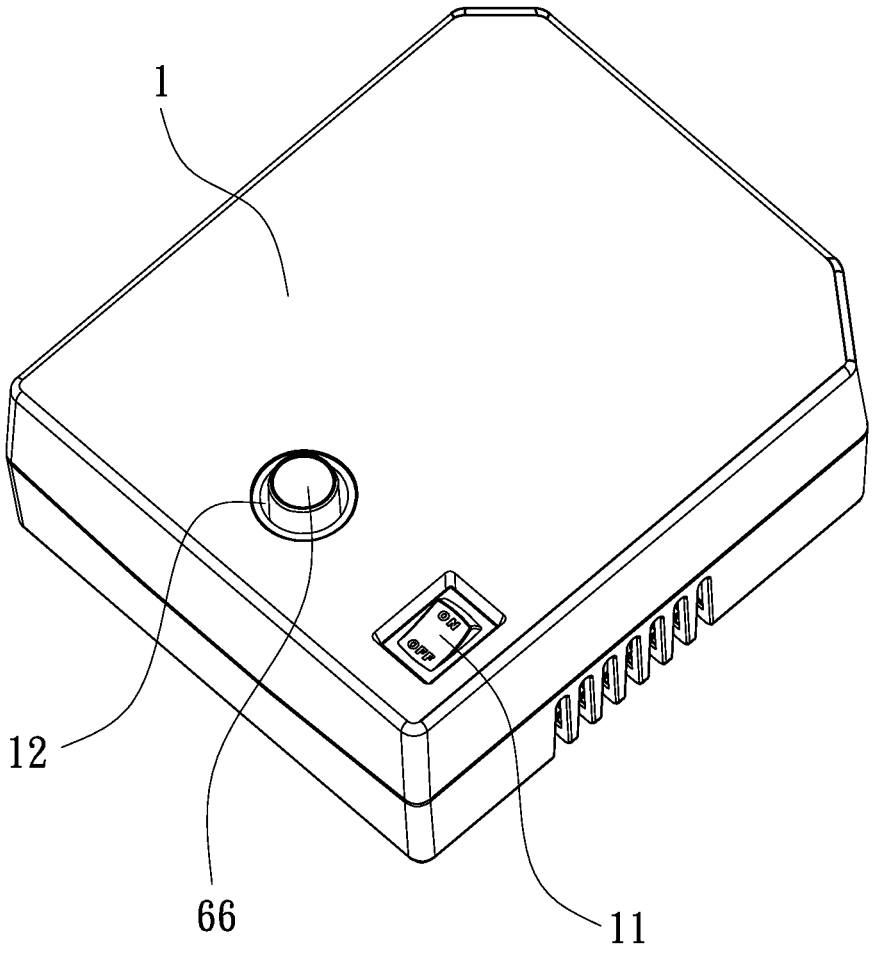
FIG. 1 shows a 3-dimensional view of an air compressor according to a first embodiment of the present invention, wherein the sliding cap of an audible alarm device is exposed to the outside through an opening of an external enclosure.
Figure 2:
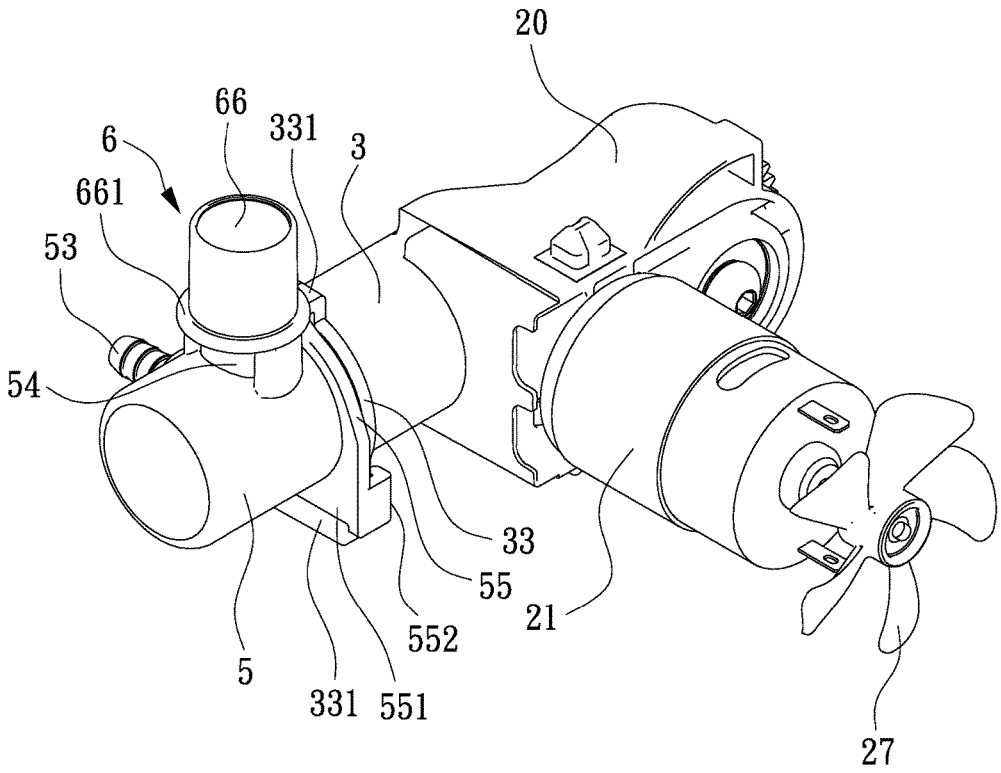
FIG. 2 shows a 3-dimensional view of a compressor unit with an audible alarm device of the first embodiment of the present invention.
Figure 3:
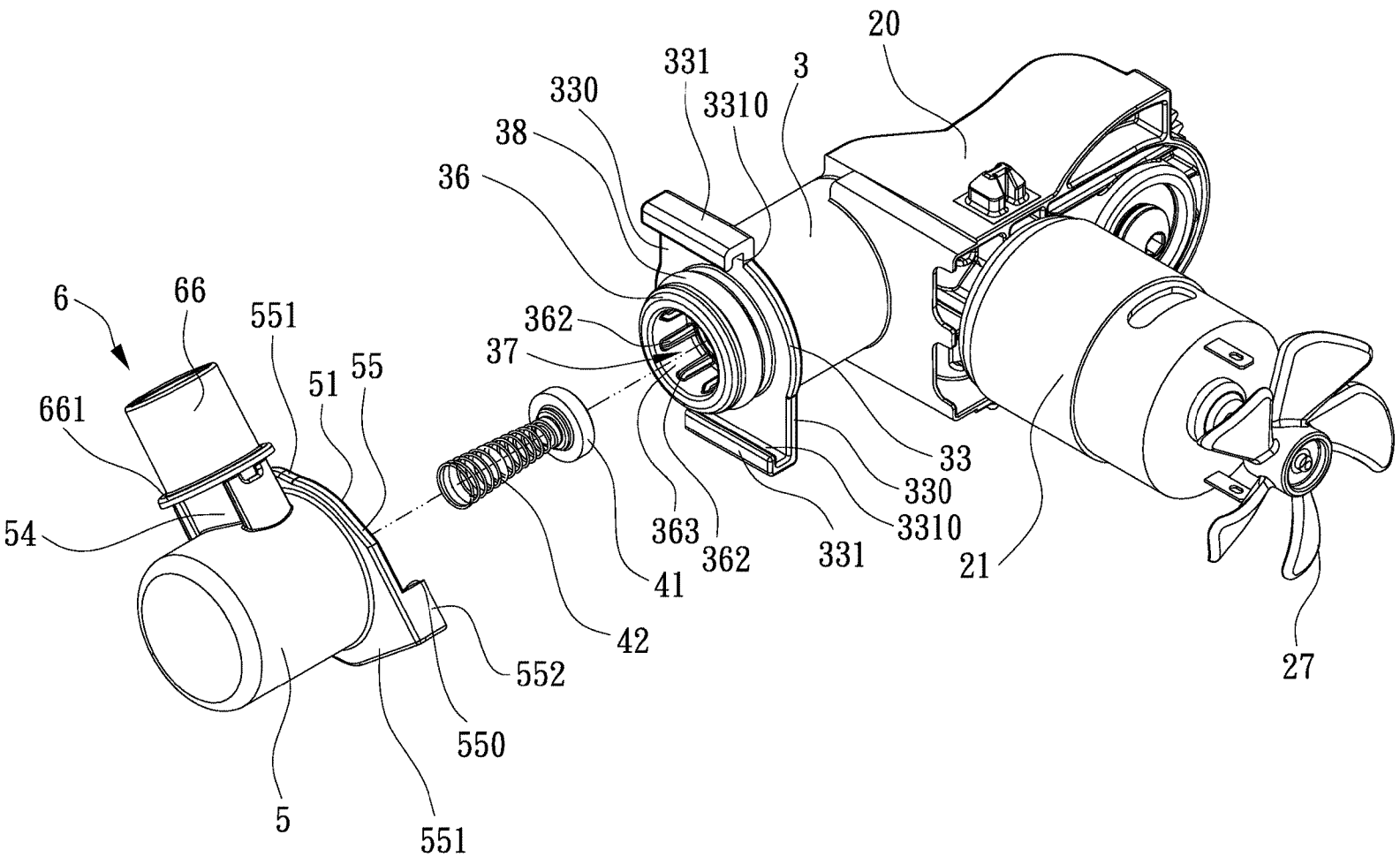
FIG. 3 shows an exploded view of the compressor unit of the first embodiment of the present invention.
Figure 4:
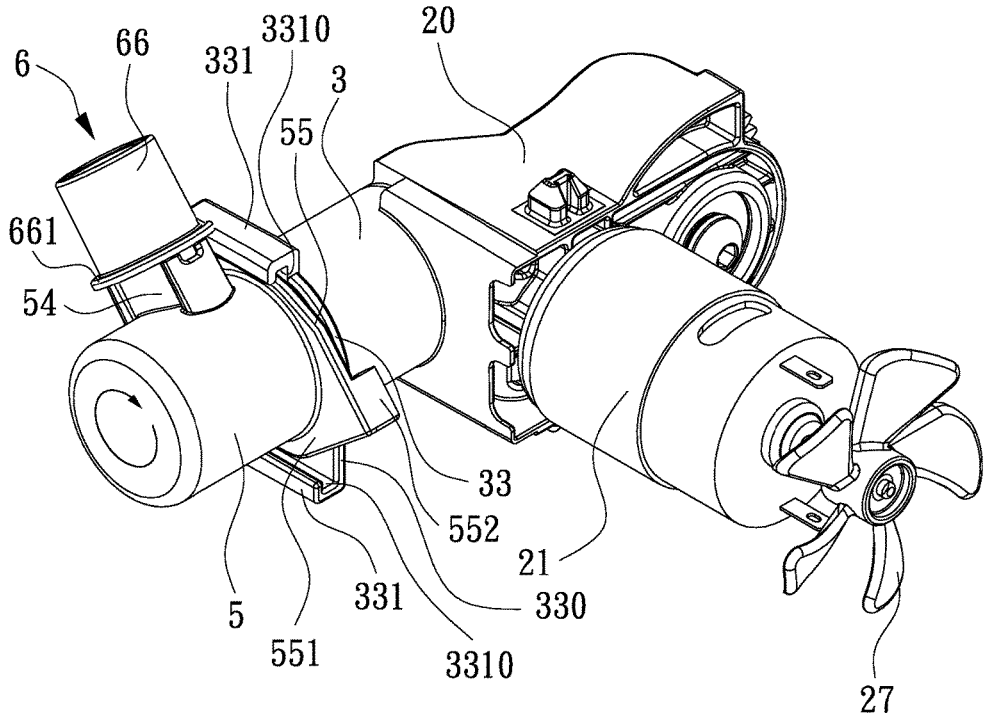
FIG. 4 shows a schematic view of the compressor unit of the first embodiment of the present invention, wherein an assembling operation between the audible alarm device and a cylinder of the compressor unit is shown
Figure 5:
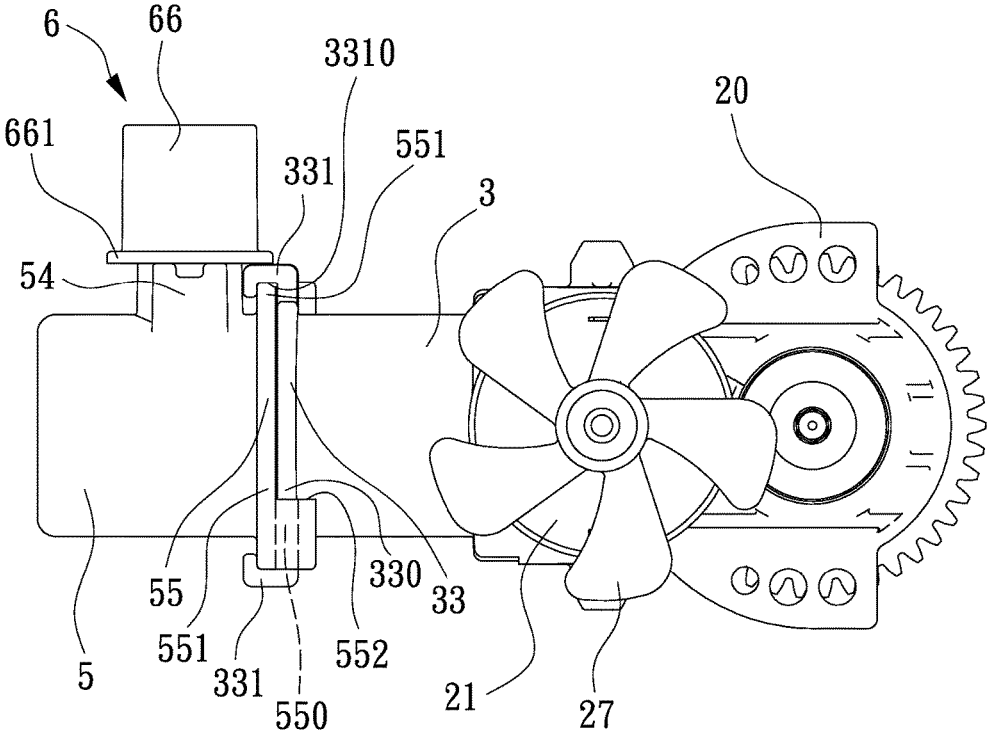
FIG. 5 shows a side view of the compressor unit of the first embodiment of the present invention.
Figure 6:
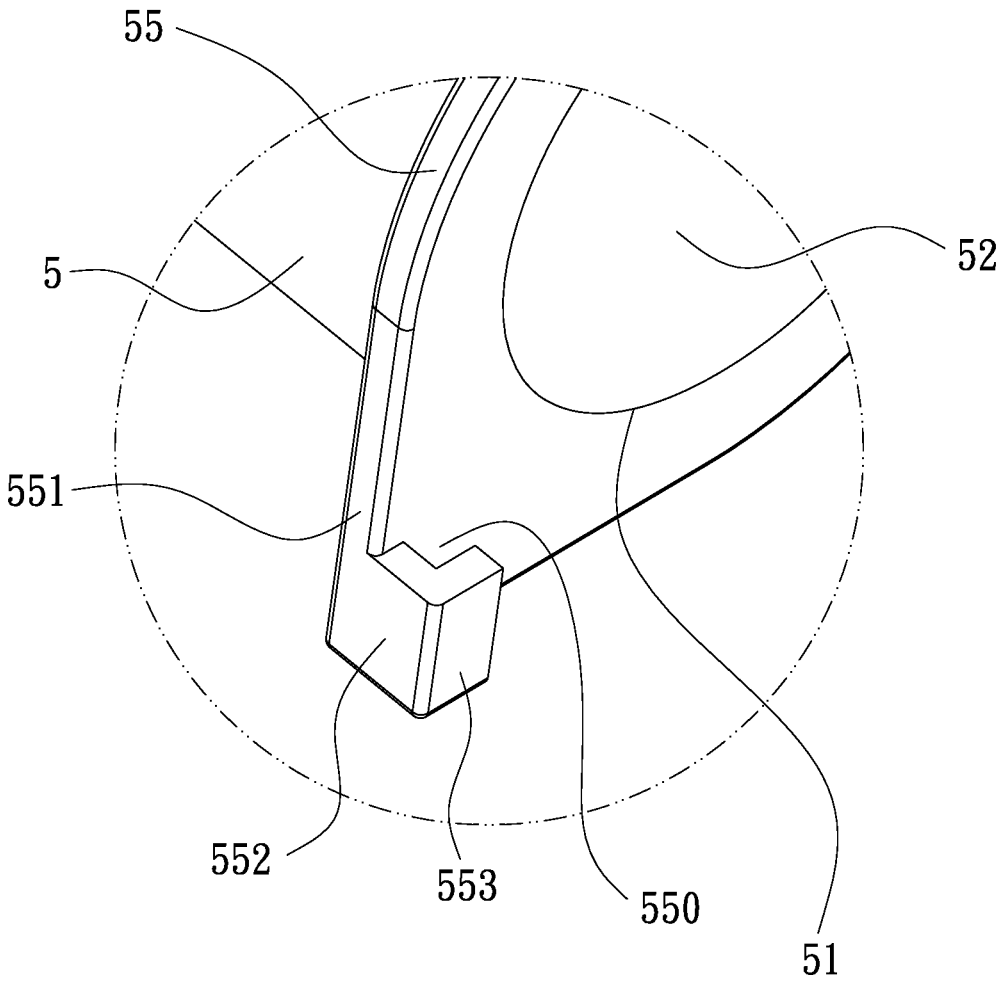
FIG. 6 shows a partially enlarged view of the coupling means of the storage container used in the compressor unit of the first embodiment of the present invention.
Figure 8:
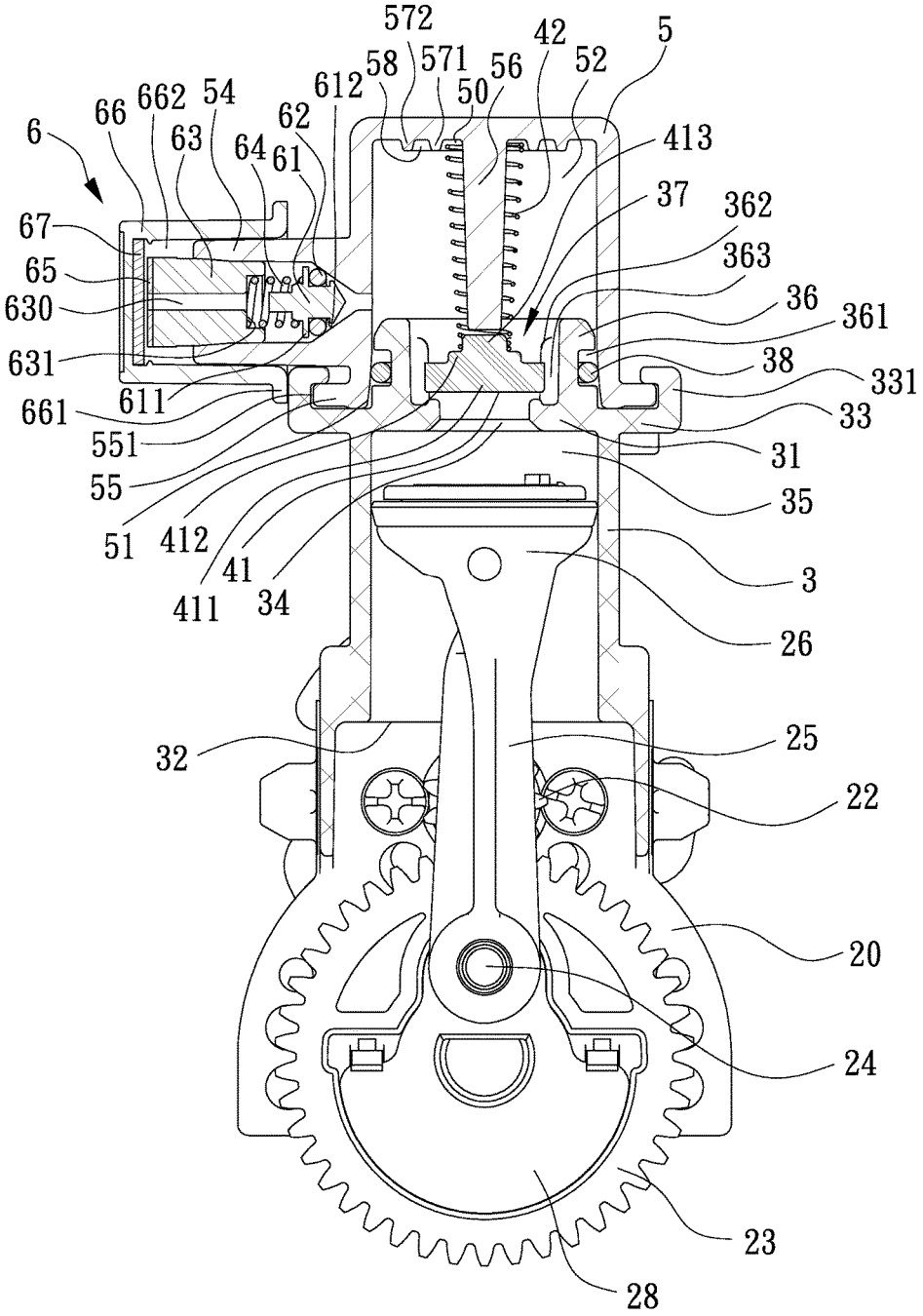
FIG. 8 shows a schematic view of the compressor unit of the first embodiment of the present invention, wherein the sliding cap of the audible alarm device is at its initial position.

As shown in FIGS. 3 and 8, the top wall 31 of the cylinder 3 defines the through hole 34 communicating with the inner space 35 of the cylinder 3 and the inn space 52 of the storage container 5 and is formed thereon with a tubular connection portion 36 that defines an annular groove 361 at its outer surface for receiving therein a seal ring 38 and is provided with a plurality of ribs 362 at its inner surface so that a ventilation gap 363 is defined between two adjacent ribs 362.

Furthermore, a valve plug 41 is provided in a central space 37 surrounded by the ribs 362. The valve plug 41 is composed of a bottom round portion 411, a middle round portion 412, and a top round portion 413, which are coaxially formed, wherein the bottom round portion 411 has a diameter greater than the middle round portion 412, and the middle round portion 412 has a diameter greater than the top round portion 413; the bottom round portion 411 has a diameter less than the central space 37 but greater than the through hole 34 of the top wall 31. The compressed air produced in the inner space 35 of the cylinder 3 is capable of entering the inner space 52 of the storage container 5 via the ventilation gaps 363 between the ribs 362.

Figure 10:
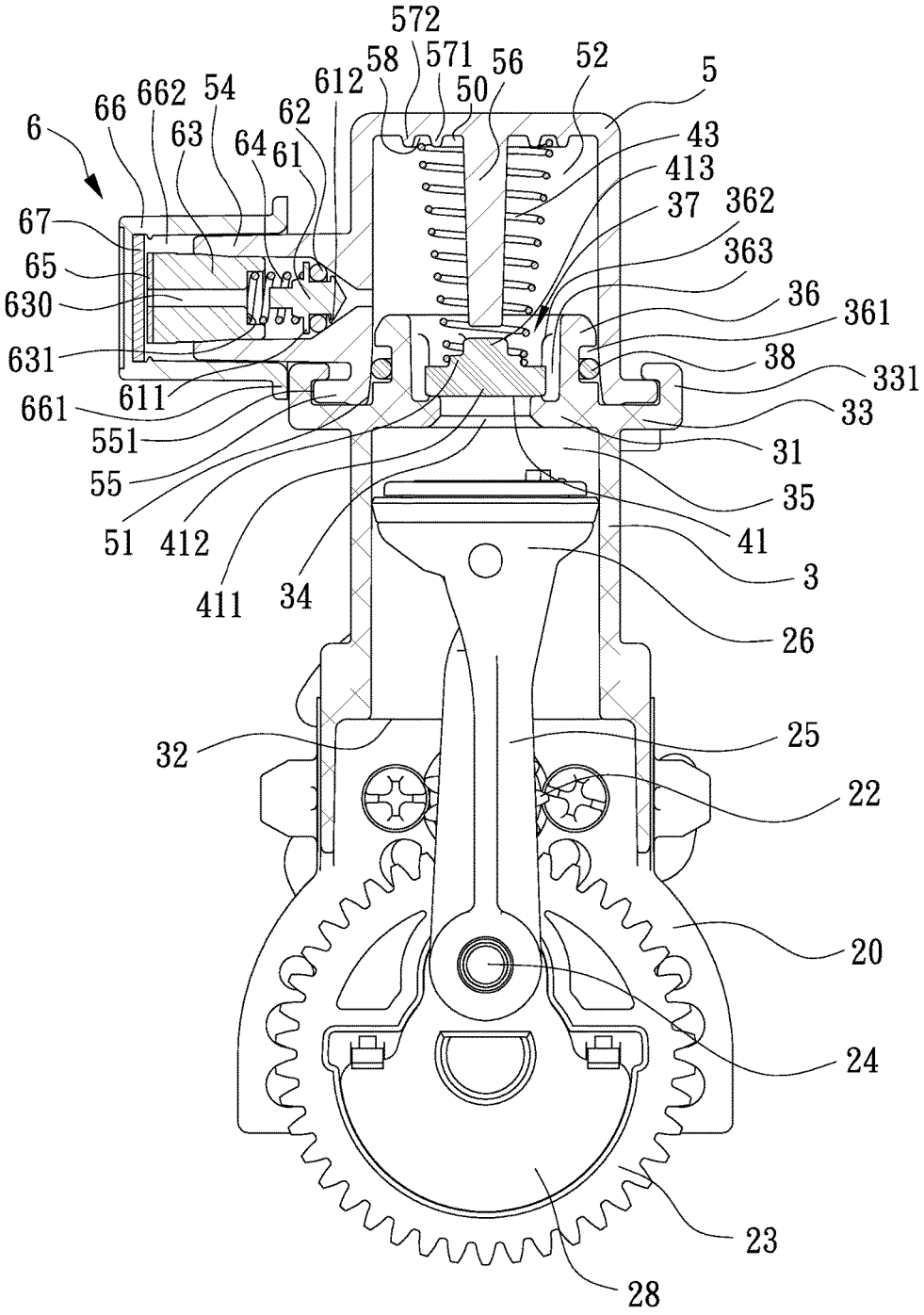
FIG. 10 shows a schematic view of the compressor unit of the first embodiment of the present invention, wherein a second spring is provided.

Furthermore, the storage container 5 is provided with a central column 56 extending downwardly from an inner surface of the closed top of the storage container 5. A first annular protrusion 571 is provided at the inner surface of the closed top of the storage container 5 around the central column 56. A second annular protrusion 572 is provided at the inner surface of the closed top of the storage container 5 around the first annular protrusion 572, such that a first annular groove 50 is defined between the central column 56 and the first annular protrusion 571, and a second annular groove 58 is defined between the first annular protrusion 571 and the second annular protrusion 572. The annular grooves 50, 58 respectively receive springs of different dimensions. For example, as shown in FIG. 8, the compression spring 42 is provided in the storage container 5 such that one end of the spring 42 is fitted around the central column 56 while urged against the first annular groove 50, and the other end of the spring 42 is fitted around the top round portion 413 of the valve plug 41 while urged against the middle round portion 412 of the valve plug 41. Additionally, as shown in FIG. 10, a second compression spring 43, which has a dimension greater than the spring 42, is provided in the storage container 5 such that one end of the second spring 43 is fitted around the central column 56 while urged against the second annular groove 58, and the other end of the second spring 43 is fitted around the middle round portion 412 of the valve plug 41 while urged against the bottom round portion 411 of the valve plug 41.

Referring again to FIG. 8, the audible alarm device 6 includes a valve plug 61, a fastening cap 63, a spring 64, and a sliding cap 66. The valve plug 61, which is disposed in the outlet 54, is provided with an annular projection 611 and a head section 612 being next to the annular projection 611 and fitted with a seal ring 62 for sealing an orifice of the outlet 54 that communicates with the inner space 52 of the storage container 5. The fastening cap 63, which seals the outlet 54 to retain the spring 64 therein, defines a through hole 630 extending from a first side thereof to a recess 631 defined at a second side thereof. Also, the first side of the fastening cap 63 is provided with a metal sheet 65. The spring 64 is provided in the outlet 54 such that one end of the spring 64 is urged against the annular projection 611 of the valve plug 61, and the other end of the spring 64 is urged against the recess 631 of the fastening cap 63. The sliding cap 66, which is provided with a flange 661 at its bottom, is slidably fitted over the outlet 54 to define a chamber 662 therebetween so that the sliding cap 66 is capable of being partially moved out of the opening 12 of the enclosure 1 and thus exposed to the outside (see FIG. 7), wherein an inner top surface of the sliding cap 66 is provided with a magnetic sheet 67 corresponding to the metal sheet 65 of the fastening cap 63.

Figure 7:
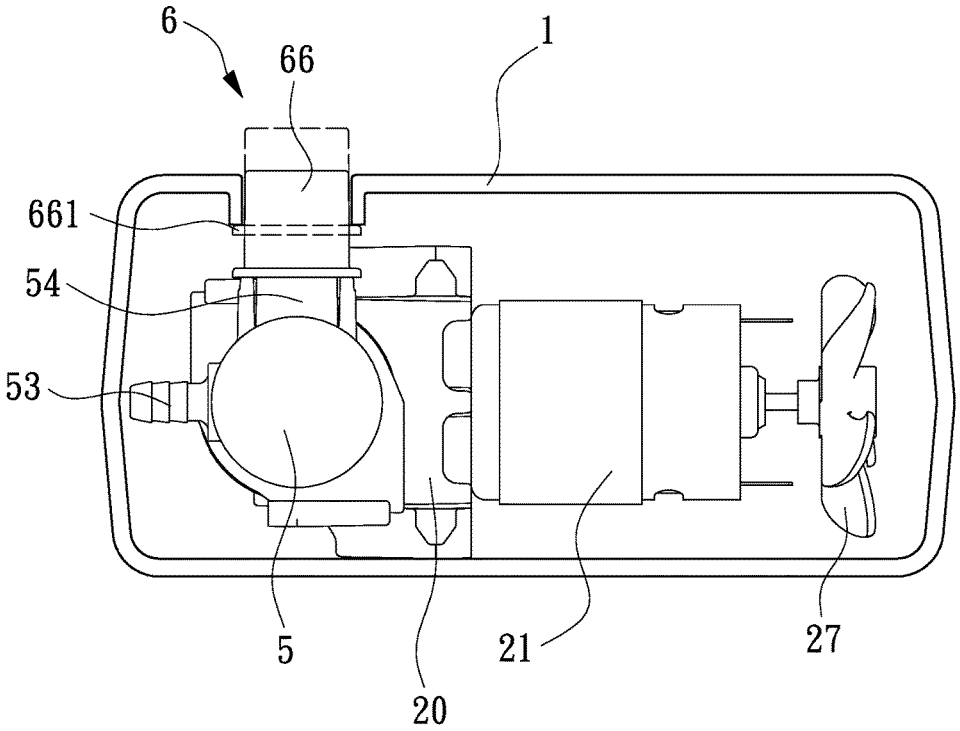
FIG. 7 shows a schematic view of the air compressor of the first embodiment of the present invention, wherein the sliding cap of the audible alarm device is moved outwardly through the opening of the external enclosure.
Figure 9:
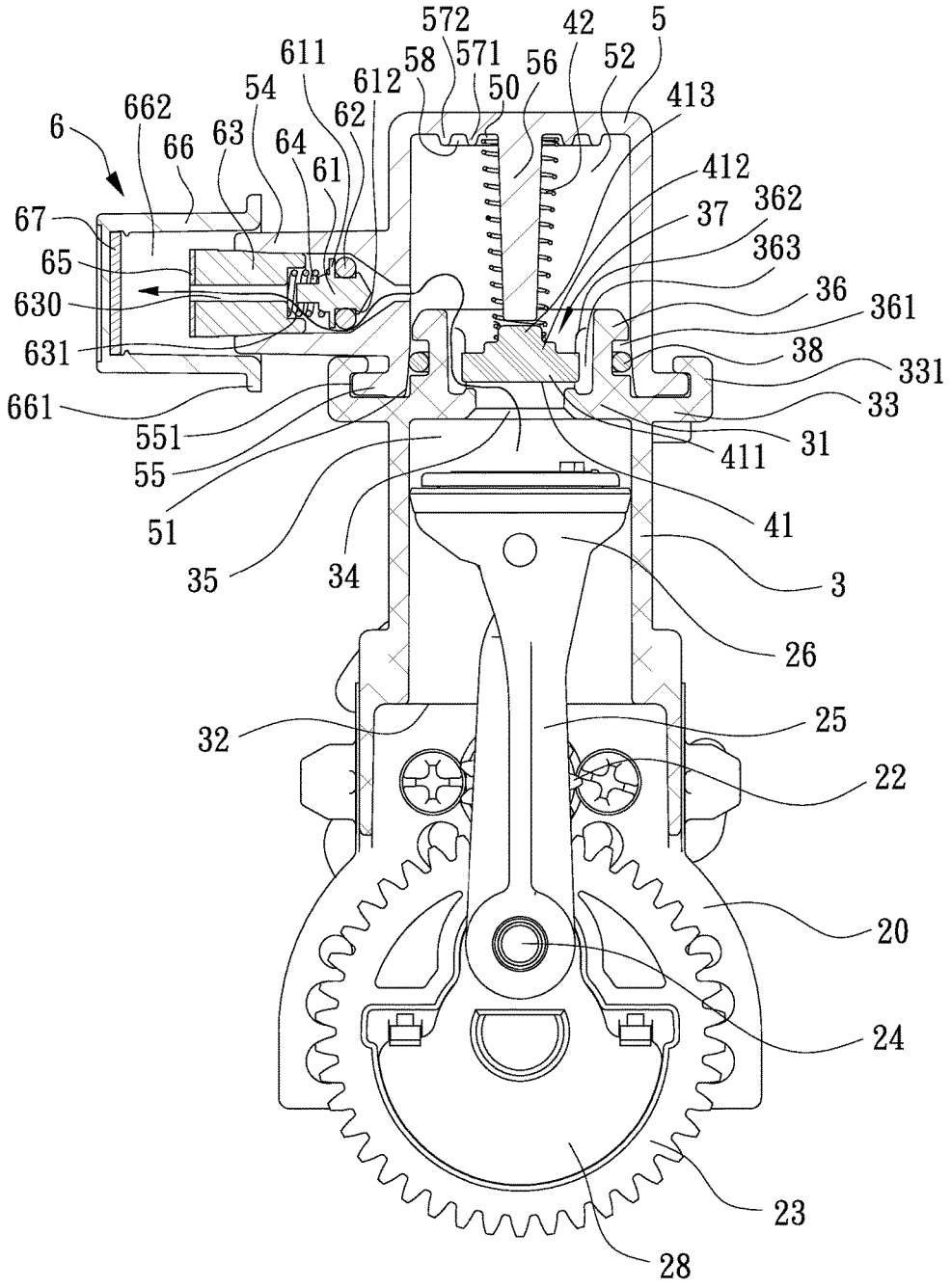
FIG. 9 shows a schematic view of the compressor unit of the first embodiment of the present invention, wherein the sliding cap of the audible alarm device is moved outwardly.

In operation, when the piston body 25 reaches TDC (top dead center) (see FIG. 8), the compressed air in the inner space 35 can be forced to enter the inner space 52 of the storage container 5, from which the compressed air can be conveyed to an object that is intended to be inflated. Through the operation of reciprocating motion, the compressed air can continually enter the storage container 5, and at the same time, the compressed air can enter the audible alarm device 6 as well. Thus, when the pressure of the compressed air in the storage container 5 or the cylinder 3 reaches a predetermined value that overcomes the force of the spring 64 of the audible alarm device 6 applied to the valve plug 61, the valve plug 61 can be moved away from the orifice of the outlet 54 that communicates with the inner space 52 of the storage container 5, so that the compressed air can flow into the chamber 662 defined between the sliding cap 66 and the outlet 54 by way of the orifice of the outlet 54 and the through hole 630 of the fastening cap 63, and thus the sliding cap 66 can be driven by the compressed air to perform a quick, slight back-and-forth movement, which has a high frequency, so that the sliding cap 66 can produce an amplifying sound of high frequency (see FIG. 9). Consequently, the sliding cap 66 can be partially moved out of the opening 12 of the external enclosure 1 and thus exposed to the outside (see FIG. 7). As shown in FIG. 7, the flange 661 of the sliding cap 66 can engage with the external enclosure 1 to limit the movement of the sliding cap 66. When users hear the sound emitting from the audible alarm device 6, they may press the switch 11 to stop the compressor unit. Upon the compressor unit is stopped, the air pressure within the storage container 5 or the cylinder 3 will fall. Due to the attracting force between the magnetic sheet 67 of the sliding cap 66 and the metal sheet 65 of the fastening cap 63, the sliding cap 65 can be attracted by the fastening cap 63 to return to its initial position, i.e., the sliding cap 66 will rest on the outlet 54 of the storage container 5 again (see FIG. 8).

Figure 15:
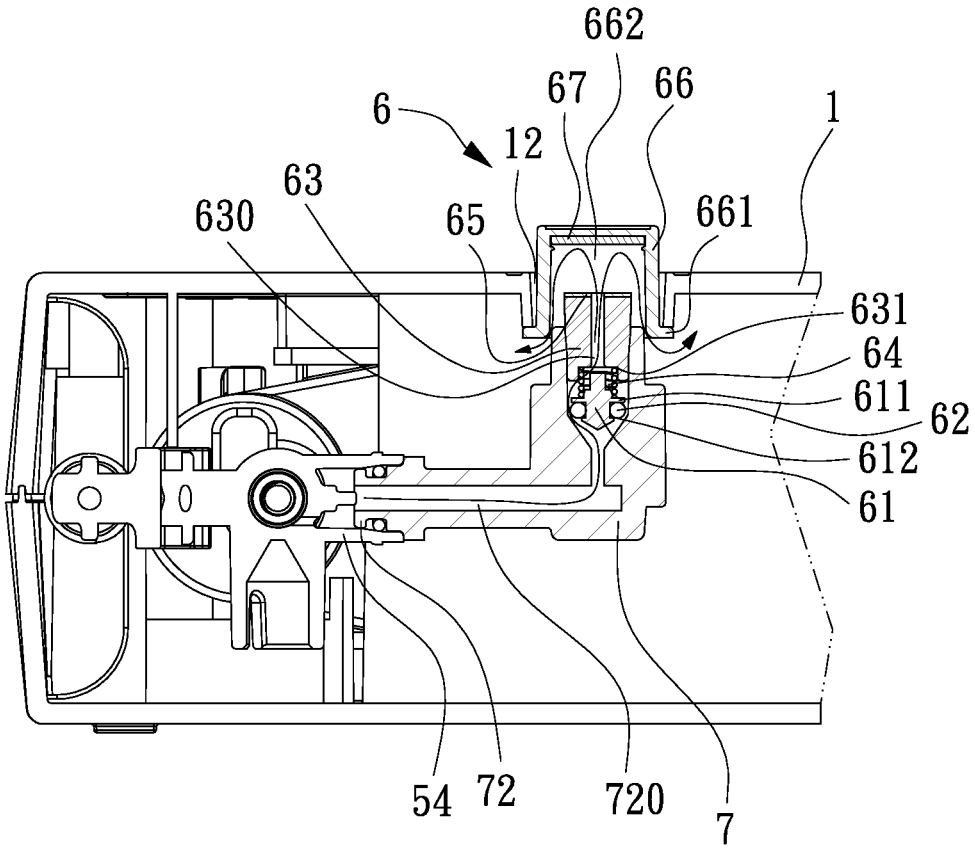
FIG. 15 shows a schematic view of the air compressor of the second embodiment of the present invention, wherein the sliding cap of the audible alarm device is moved outwardly through the opening of the external enclosure.

FIGS. 11 through 15 show a second embodiment of the present invention, wherein the audible alarm device 6 is mounted to the outlet 54 through an adapter 7, which is provided with a connector 72 at a first end thereof for connecting with the outlet 54 and defines a channel 720 extending from the connector 72 to a receiving space defined at a second end thereof. The audible alarm device 6 includes a valve plug 61, a fastening cap 63, a spring 64, and a sliding cap 66. The valve plug 61, which is disposed in the receiving space of the adapter 7, is provided with an annular projection 611 and a head section 612 being next to the annular projection 611 and fitted with a seal ring 62 for sealing the channel 720 of the adapter 7. The fastening cap 63 defines a through hole 630 extending from a first side thereof to a recess 631 defined at a second side thereof, wherein the first side of the fastening cap 63 is provided with a metal sheet 65. The spring 64 is provided in the receiving space of the adapter 7 and retained by the fastening cap 66 that seals the receiving space of the adapter 7, wherein one end of the spring 64 is urged against the annular projection 611 of the valve plug 61, and the other end of the spring 64 is urged against the recess 631 of the fastening cap 63. The sliding cap 66, which is provided with a flange 661 at its bottom, is slidably fitted over the second end of the adapter 7 to define a chamber 662 therebetween so that the sliding cap 66 is capable of being partially moved out of the opening 12 of the enclosure 1 and exposed to the outside (see FIG. 15), wherein an inner top surface of the sliding cap 66 is provided with a magnetic sheet 67 corresponding to the metal sheet 65 of the fastening cap 63. Furthermore, the connector 72 of the adapter 7 can be provided with two opposite holding portions 71 each defining a receiving slot, while the outlet 54 can be provided with a rectangular plate 59 that can be fitted in the receiving slots of the holding portions 71, whereby the audible alarm device can be quickly and detachably mounted to the outlet 54 through the adapter 72. With the adapter 7, the audible alarm device 6 can be detachably mounted to the outlet 54. Through the reciprocating motion of the piston body 25, the compressed air can continually enter the storage container 5, and at the same time, the compressed air can enter the audible alarm device 6 as well. Thus, when the pressure of the compressed air in the storage container 6 or the cylinder 3 reaches a predetermined value that overcomes the force of the spring 64 of the audible alarm device 6 applied to the valve plug 61, the valve plug 61 can be moved away from the receiving space of the adapter 7 that communicates with the inner space 54 of the storage container 5 through the adapter 7, so that the compressed air can flow into the chamber 662 defined between the sliding cap 66 and the second end of the adapter 7 by way of the orifice of the outlet 54, the channel 720 of the adapter 7, and the through hole 630 of the fastening cap 63, and thus the sliding cap 66 can be driven by the compressed air to perform a quick, slight back-and-forth movement of high frequency, so that the sliding cap 66 can produce an amplifying high-frequency sound (see FIG. 15). Consequently, the sliding cap 66 can be partially moved out of the opening 12 of the external enclosure 1 and thus exposed to the outside. As shown in FIG. 15, the flange 661 of the sliding cap 66 can engage with the external enclosure 1 to limit the movement of the sliding cap 66. When users hear the sound emitting from the audible alarm device 6, they may press the switch 11 to stop the compressor unit. Upon the compressor unit is stopped, the air pressure within the storage container 5 or the cylinder 3 will fall. Due to the attracting force between the magnetic sheet 67 of the sliding cap 66 and the metal sheet 65 of the fastening cap 63, the sliding cap 66 can be attracted by the fastening cap 63 to return to its initial position (see FIG. 14).

In light of the foregoing, the primary feature of the present invention is that the compressor unit mounted with the audible alarm device 6 can produce a high-frequency warning sound for users when the air pressure within the storage container 5 or the cylinder 3 exceeds a predetermined value, and thus the air compressor can be operated more conveniently and safely to inflate objects without causing overpressure.

I claim:

1. In an air compressor that includes an external enclosure having an opening at its outer surface and an electrically-operated compressor unit within the enclosure, the compressor unit including a cylinder and a storage container provided with a plurality of outlets, the storage container communicating with the cylinder, the cylinder being fitted with a piston body driven by a motor for conducing a reciprocating motion for supplying compressed air into the storage container, wherein the improvement comprises:

at least one outlet of the plurality of outlets is mounted with an audible alarm device, which includes a valve plug, a fastening cap, a spring, and a sliding cap, the valve plug disposed in the outlet and provided with an annular projection and fitted with a seal ring for sealing an orifice of the at least one outlet communicating with an inner space of the storage container, the fastening cap sealing the outlet and defining a through hole extending from a first side thereof to a recess defined at a second side thereof, the spring fitted between the recess of the fastening cap and the annular projection of the valve plug, the sliding cap being slidably fitted over the outlet to define a chamber therebetween, the valve plug provided with a head section next to the annular projection, the first side of the fastening cap provided with a metal sheet, the sliding cap provided at its bottom with a flange, an inner top surface of the sliding cap provided with a magnetic sheet corresponding to the metal sheet of the fastening cap; whereby when the compressed air within the storage container reaches a predetermined pressure, the audible alarm device produces a high-frequency sound for alerting users, and the sliding cap is capable of being partially moved out of the opening of the enclosure.

2. The air compressor of claim 1, wherein the cylinder has a top wall and an open bottom, the top wall of the cylinder being formed with a first coupling means that includes two substantially opposite plates extending outwardly from the top wall, one side of each plate being formed into a first holding portion defining first receiving slots; and further wherein the storage container has a closed top and an open bottom, wherein the open bottom is formed with a second coupling means that includes two substantially opposite plates extending outwardly from a surrounding wall of the storage container, one side of each opposite plate being formed into a second holding portion that has a base section and an end section, the base section being perpendicular to a corresponding plate of the storage container, the end section being parallel to a corresponding plate of the storage container to thus define second receiving slots between the base section and the end section; whereby the storage container is capable of being rotated to allow the plates thereof to slide in the first receiving slots and allow the plates of the cylinder to slide in the second receiving slots, wherein the plates of the cylinder are limited by the base sections of the storage container, so that the storage container is firmly and detachably mounted to the cylinder.

3. The air compressor of claim 2, wherein the top wall of the cylinder defines a through hole communicating with an inner space of the cylinder and the inner space of the storage container and is formed thereon with a tubular connection portion that defines an annular groove at its outer surface for receiving therein a seal ring and is provided with a plurality of ribs at its inner surface so that a ventilation gap is defined between two adjacent ribs;

further wherein a second valve plug is provided in a central space surrounded by the ribs, the second valve plug having coaxially formed portions including a bottom round portion, a middle round portion and a top round portion, the bottom round portion having a diameter greater than the middle round portion, the middle round portion having a diameter greater than the top round portion, the bottom round portion having a diameter less than the central space but greater than the through hole of the top wall, the compressed air produced in the inner space of the cylinder being able to enter the inner space of the storage container via the ventilation gaps between the ribs; further wherein the storage container is provided with a central column extending downwardly from an inner surface of the closed top of the storage container, a first annular protrusion at the inner surface of the closed top of the storage container around the central column, and a second annular protrusion at the inner surface of the closed top of the storage container around the first annular protrusion, such that a first annular groove is defined between the central column and the first annular protrusion, and a second annular groove is defined between the first annular protrusion and the second annular protrusion; and further wherein a second spring is provided in the storage container such that one end of the second spring is fitted around the central column while urged against the first annular groove, and an opposite end of the second spring is fitted around the top round portion of the second valve plug while urged against the middle round portion of the second valve plug.

4. The air compressor of claim 3, wherein a second spring is provided in the storage container such that one end of the second spring is fitted around the central column while urged against the second annular groove, and an opposite end of the second spring is fitted around the middle round portion of the valve plug while urged against the bottom round portion of the valve plug.

5. In an air compressor that includes an external enclosure having an opening at its outer surface and an electrically-operated compressor unit within the enclosure, the compressor unit including a cylinder and a storage container provided with a plurality of outlets, the storage container communicating with the cylinder, the cylinder being fitted with a piston body driven by a motor for conducing a reciprocating motion for supplying compressed air into the storage container, wherein the improvement comprises:

an audiable alarm device is mounted to at least one outlet of the plurality of outlets, the audible alarm device including a valve plug, a fastening cap, a spring, and a sliding cap, the fastening cap defining a through hole extending from a first side thereof to a recess defined at a second side thereof, the spring fitted between the recess of the fastening cap and the valve plug, the sliding cap being slidably fitted over the fastening cap to define a chamber therebetween, the first side of the fastening cap provided with a first magnetic attachable sheet, an inner top surface of the sliding cap provided with a second magnetic attachable sheet corresonding to the first magnetic attachable sheet of the fastening cap; whereby when the compressed air within the storage container reaches a peredetermined pressure, the audible alarm device produces a high-frequency sound for alerting users, and the sliding cap is capable of being partially moved out of the opening of the enclosure.

6. The air compressor of claim 5, wherein the first magnetic attachable sheet is a metal sheet while the second magnetic attachable sheet is a magnetic sheet.

7. The air compressor of claim 5, wherein the audible alarm device is connected with the outlet such that the valve plug is disposed in the outlet and fitted with a seal ring for sealing an orifice of the outlet that communicating with an inner space of the storage container, the fastening cap sealing the outlet, the sliding cap provided with a flange at its bottom.

8. The air compressor of claim 5, wherein the audible alarm device is coupled to the outlet through an adapter that is provided with a connector at a first end thereof and defines a channel extending from the connector to a receiving space defined at a second end thereof, the valve plug disposed in the receiving space of the adapter and fitted with a seal ring for sealing the channel of the adapter, the fastening cap sealing the receiving space of the adapter, the sliding cap provided with a flange at its bottom.

9. The air compressor of claim 8, wherein the connector of the adapter is provided with two opposite holding portions each defining a receiving slot, while an inlet is provided with a rectangular plate that is capable of being fitted in the receiving slots of the holding portions of the adapter, whereby the audible alarm device is quickly and detachably coupled to the inlet through the adapter.

10. In an air compressor that includes an external enclosure having an opening at its outer surface and an electrically-operated compressor unit within the enclosure, the compressor unit including a cylinder and a storage container provided with a plurality of outlets, the storage container communicating with the cylinder, the cylinder being fitted with a piston body driven by a motor for conducing a reciprocating motion for supplying compressed air into the storage container, wherein the improvement comprises:

at least one outlet of the plurality of outlets is mounted with an audible alarm device to produce a high -requency sound for alerting users when the compressed air within the storage container or the cylinder reaches a predetermined value; and the cylinder has a top wall and an open bottom, the top wall of the cylinder being formed with a first coupling means that includes two substantially opposite plates extending outwardly from the top wall, one side of each plate being formed into a first holding portion defining first receiving slots; and further wherein the storage container has a closed top and an open bottom, wherein the open bottom is formed with a second coupling means that includes two substantially opposite plates extending outwardly from a surrounding wall of the storage container, one side of each opposite plate being formed into a second holding portion that has a base section and an end section, the base section being perpendicular to a corresponding plate of the storage container, the end section being parallel to a corresponding plate of the storage container to thus define second receiving slots between the base section and the end section; whereby the storage container is capable of being rotated to allow the plates thereof to slide in the first receiving slots and allow the plates of the cylinder to slide in the second receiving slots, wherein the plates of the cylinder are limited by the base sections of the storage container, so that the storage container is firmly and detachably mounted to the cylinder.

11. The air compressor of claim 10, wherein the top wall of the cylinder defines a through hole communicating with an inner space of the cylinder and the inner space of the storage container and is formed thereon with a tubular connection portion that defines an annular groove at its outer surface for receiving therein a seal ring and is provided with a plurality of ribs at its inner surface so that a ventilation gap is defined between two adjacent ribs; further wherein a second valve plug is provided in a central space surrounded by the ribs, the second valve plug having coaxially formed portions including a bottom round portion, a middle round portion and a top round portion, the bottom round portion having a diameter greater than the middle round portion, the middle round portion having a diameter greater than the top round portion, the bottom round portion having a diameter less than the central space but greater than the through hole of the top wall, the compressed air produced in the inner space of the cylinder being able to enter the inner space of the storage container via the ventilation gaps between the ribs; further wherein the storage container is provided with a central column extending downwardly from an inner surface of the closed top of the storage container, a first annular protrusion at the inner surface of the closed top of the storage container around the central column, and a second annular protrusion at the inner surface of the closed top of the storage container around the first annular protrusion, such that a first annular groove is defined between the central column and the first annular protrusion, and a second annular groove is defined between the first annular protrusion and the second annular protrusion; and further wherein a spring is provided in the storage container such that one end of the spring is fitted around the central column while urged against the first annular groove, and an opposite end of the spring is fitted around the top round portion of the second valve plug while urged against the middle round portion of the second valve plug.

12. The air compressor of claim 11, wherein a second spring is provided in the storage container such that one end of the second spring is fitted around the central column while urged against the second annular groove, and an opposite end of the second spring is fitted around the middle round portion of the valve plug while urged against the bottom round portion of the valve plug.

* * * * *